United States Patent [19]

Birat

[11] 3,987,840

[45] Oct. 26, 1976

[54] METHOD AND APPARATUS FOR CONTINUOUSLY CASTING OF METAL IN HORIZONTAL DIRECTION

[75] Inventor: Jean-Pierre Birat, Metz, France

[73] Assignee: Institut de Recherches de la Siderurgie Francaise (IRSID), Saint-Germain-en-Laye, France

[22] Filed: Nov. 27, 1974

[21] Appl. No.: 527,866

[30] Foreign Application Priority Data

Nov. 28, 1973 France ..... 73.42268

[52] U.S. Cl. ..... 164/49; 164/147; 164/281 H

[51] Int. Cl.[2] ..... B22D 11/00

[58] Field of Search ..... 164/49, 82, 133, 146, 164/147, 148, 251, 281

[56] References Cited

UNITED STATES PATENTS

| | | | |
|---|---|---|---|
| 3,263,283 | 8/1966 | Allard | 164/49 |
| 3,451,465 | 6/1969 | Moritz | 164/281 X |
| 3,630,266 | 12/1971 | Watts | 164/82 X |

*Primary Examiner*—Francis S. Husar
*Assistant Examiner*—Gus T. Hampilos
*Attorney, Agent, or Firm*—Michael J. Striker

[57] ABSTRACT

A method for continuously casting metal in horizontal direction in which molten metal is continuously discharged from a container through a conduit of refractory material into a horizontally-extending cooled ingot mold axially aligned with the conduit. The flow passage formed by the conduit and the ingot mold increases abruptly at the junction of the conduit and the ingot mold. The outer periphery zone of the stream of molten metal passing through the conduit is accelerated by electromagnetic force so as to enter into the ingot mold in such a manner as to create immediately downstream of the junction an annular space free of metal; and an apparatus for carrying out the method.

11 Claims, 1 Drawing Figure

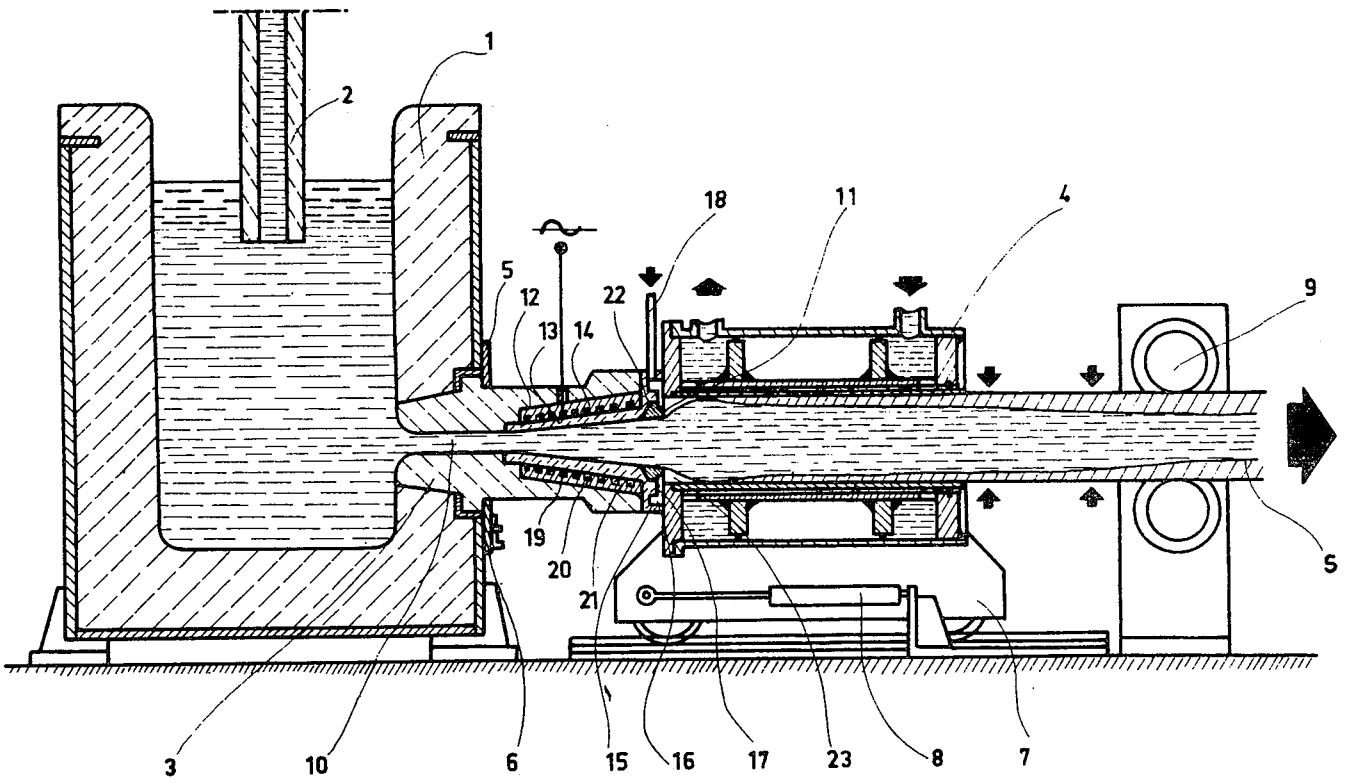
1
2
3
4
5
6
7
8
9
10
11
12
13
14
15
16
17
18
19
20
21
22
23

METHOD AND APPARATUS FOR CONTINUOUSLY CASTING OF METAL IN HORIZONTAL DIRECTION

BACKGROUND OF THE INVENTION

The present invention relates to a method and apparatus for continuously casting of metal in horizontal direction.

The technique of continuously casting metal in horizontal direction comprises the step of causing the molten metal to flow continuously from a container of refractory material through an opening in the side wall thereof into a cooled ingot mold open at opposite ends and arranged in horizontal direction, and to withdraw the partially solidified product produced in the ingot mold from the latter. The process of progressive solidification of the product in the interior of the ingot mold is known so that the manner of extraction of the product as well as the manner of function and construction of the ingot mold constitute aspects of the technique in question which may be considered as well mastered, and for which various satisfactory solutions have already been proposed.

However, this is not the case as far as the flow of the molten metal from the container towards the ingot mold is concerned. To obtain a satisfactory flow of the metal poses a technological problem in realizing an effective joint between the container of refractory material and the cooled ingot mold. It has been ascertained that the metal has a tendency to start solidification not in the ingot mold, but already in the region of the joint or connection between the container and the ingot mold, which phenomenon causes the metal to stick to the joint, and leads to a tearing or renting of the solidified portion, provoked by the traction imparted to the product to withdraw the latter from the ingot mold. This causes considerable difficulties in the casting process and such tearing will result into considerable surface defects in the cast product, in fact, the defects may create openings upstream of the ingot mold causing thereby a complete emptying of the metal from the container or refractory material. In addition, the aforementioned sticking of the metal causes a progressive deterioration of the joint, which, in turn, contributes to an amplification of the above-mentioned phenomenon and will lead almost unavoidably to a stopping of the casting operation, the faster, the higher the temperature of the molten metal is. It is for this reason that the technique of continuously casting metal, especially steel, in horizontal direction is at the present time not generally used, and this despite notable perfections with regard to the joints used, as well as with regard to the choice of material which form the joint.

Various propositions have already been made to resolve the above-mentioned problem of passing of molten metal from a container of refractory material into a horizontally extending ingot mold. For instance, the U.S. Pat. No. 3,630,266 describes a method of continuously casting metal in horizontal direction according to which a stream of molten metal is caused to flow through a conduit of refractory material into a cooled ingot mold having an inner cross section superior to the cross section of the conduit of refractory material, and in which a fluid under pressure is injected into the space between the external periphery of the conduit of refractory material and the internal surface of the adjacent ingot mold in such a manner to press the molten metal out of the aforementioned space. This arrangement aims to substitute a fluid joint for a solid joint which can be continuously renewed. More specifically, the arrangement disclosed in the aforementioned patent constitutes a way to put into practice an improvement in fluid joints, to be used in a method and apparatus of continuously casting metal in horizontal direction. The molten metal flows directly from the conduit of refractory material into the ingot mold by forming a meniscus in such a manner that the start of the solidification of the metal in the ingot mold can in no way lead to a deterioration of the extremity of the conduit of refractory material. The arrangement to put into practice the aforementioned method has therefore the characteristic that the conduit of refractory material is not in material contact with the ingot mold.

Considering the substantial vertical disposition of the aforementioned meniscus, it will follow that the essential uniform pressure of the fluid will be opposed to the ferrostatic pressure, the value of which will linearly increase with the height of the interface between fluid and the liquid metal. This will lead to a certain instability of the geometry of the meniscus, which instability will only be partially diminished by the existence of surface tensions. Due to this instability, the molten metal is liable to penetrate, for moments, in the space located between the extremity of the conduit refractory material and the adjacent wall of the ingot mold and solidify there, which will lead to the tearing of the solidifying metal mentioned above and which, in addition, may occasion a piercing at the level of the fluid joint, so that the latter will not be able any longer to function satisfactorily.

SUMMARY OF THE INVENTION

The present invention aims to overcome the disadvantages of the known method and apparatus mentioned above.

More specifically, the present aims to stabilize the geometry of the interface between fluid and molten metal forming in the zone situated between the end of the conduit of refractory material having a substantially horizontal axis and the internal surface of an ingot mold disposed closely adjacent the aforementioned end and aligned with the same along a common axis.

With these and other objects in view, which will become apparent as the description proceeds, the method according to the present invention of continuously casting metal mainly comprises the steps of continuously discharging molten metal from a container into a cooled, substantially horizontally extending ingot mold, open at opposite ends, through a conduit of refractory material extending axially aligned with the ingot mold between an opening in the side wall of the container and one of the open ends of the ingot mold and in which the flow passage formed by conduit and the ingot mold increases abruptly at the junction of these two elements, creating in the stream of metal passing through the conduit of refractory material electromagnetic forces for producing in the peripheral zone of the stream of metal an acceleration having a component in the direction of flow of the stream so as to form a liquid meniscus of stable configuration in the region of the aforementioned junction, and continuously withdrawing the product formed in the ingot mold from the other end of the latter.

The apparatus of the present invention for continuously casting metal mainly comprises a container of refractory material having an opening in a side wall thereof, means for continuously feeding molten metal into the container, a conduit of refractory material having one end located in the aforementioned opening of the container, a cooled ingot mold abutting against the other end of the conduit, the conduit and the ingot mold being axially aligned with each other and extending in horizontal direction, the flow passage formed by the conduit and the ingot increasing abruptly at the junction of the conduit and the ingot mold. Means are further provided in the region of the junction for creating a magnetic field in such a manner so as to produce in the peripheral zone of the stream of molten metal passing through the conduit into the ingot mold electromagnetic forces having a component in the direction of flow of the stream, and means for continuously withdrawing the product formed in the ingot mold from the latter.

The aforementioned means for creating an electromagnetic field preferably comprise an electromagnetic inductor located upstream of the junction.

It will be understood that the present invention uses as principal means to obtain the desired effect of a modification of the flow condition of the metal in a judiciously located zone a brisk increase of the cross section of the flow passage for the metal. This modification of the flow condition consists to impart to the mass of liquid metal located at the periphery of the stream of metal in the aforementioned zone a kinetic energy which is sufficiently large as compared to the forces of gravity so that the general direction of flow of the stream of liquid metal will not undergo a substantial modification in the region of the aforementioned junction. In other words, the method according to the present invention tends to produce an injection of molten metal into the ingot mold, whereby the term injection has to be interpreted as illustration of the phenomenon and which, in fact, occurs only in the peripheral zone of the stream of molten metal as will be explained later on. The term "meniscus" in the following description is to be considered as the external surface of the stream of liquid metal which is located between the downstream end of the conduit of refractory material and the internal surface of the ingot mold in the zone of contact of the metal with the mentioned internal surface.

The kinetic energy imparted to the liquid metal will provide a certain rigidity at the peripheral zone of the metal stream in the region of the aforementioned junction. However, the geometric stability of the meniscus will be further improved when the conditions of pressure which prevail on both sides of the periphery of the stream of liquid metal are similar. For this reason, the method according to the present invention may also include, as a complementary step, the injection of fluid in the annular space between the periphery of the stream of liquid metal in the region of the junction, the end face of the conduit and the inner surface of the ingot mold. The fluid is injected as a pressure at least equal and preferably slightly superior to the maximum ferrostatic pressure in the aforementioned region.

According to an advantageous manner to carry out the method according to the present invention, the liquid metal is passed through a conduit of refractory material in which the cross section of the conduit increases progressively in the direction of flow of the metal and that electromagnetic forces are produced in the peripheral zone of the stream of liquid metal to create an acceleration thereof substantially parallel to the inner surface of the conduit of refractory material. This permits to obtain in the region of the junction of the conduit and the ingot mold a diverging stream of metal to facilitate in this way the passage of liquid metal from the conduit of refractory material into the ingot mold, such that the geometric stability of the meniscus is substantially improved.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

The single drawing FIGURE illustrates a longitudinal cross section through the apparatus according to the present invention.

DESCRIPTION OF THE PREFERRED EMBODIMENTS

As shown in the drawing, the apparatus for continuously casting metal in horizontal direction mainly comprises an upright container 1 formed of refractory material into which molten metal is continuously fed, for example, through a nozzle or pipe 2 the lower end extends into the molten metal in the container so as to maintain in the latter a substantially constant level of molten metal. The right side wall, as viewed in the drawing, of the container 1 is formed adjacent the bottom thereof with an opening into which one end of a tube 3 of refractory material extends projecting in substantially horizontal direction from the aforementioned side wall. The end of the tube 3 is cemented into the aforementioned opening of the side wall and maintained in position by plates 5 and 6 connected in any convenient manner to the metallic sheathing surrounding the container and engaging an annular collar on the tube 3. The tube 3 communicates at its outer end with an ingot mold 4 of circular cross section, preferably formed from copper, which is axially aligned with the tube 3 and projects horizontally from the outer end of the latter. The ingot mold 4 is surrounded by a jacket through which a cooling medium, for instance water, is circulated as indicated by the arrows, in a manner well known in the art. The ingot mold 4 is mounted on a carriage 7 which can be displaced in longitudinal direction by a jack 8 in order to apply one of the ends of the ingot mold against the corresponding end of the conduit 3 of refractory material. The apparatus comprises further a set of extraction wheels and wheels to maintain the metal strand S partly solidified in the in$_{\varepsilon}$ t mold 4 in proper position downstream of the latter, but only a single pair of extraction wheels 9 are shown in the drawing in order not to unnecessarily crowd the latter and since such extraction wheels and wheels to maintain the partly solidified strand in proper position as well known in the art.

The conduit 3 of refractory material will now be further described. The conduit 3 defines a passage 10 for the flow of molten metal therethrough and this passage comprises a first portion of cylindrical cross section and a second portion having a cross section which progressively increases toward the ingot mold 4, with the greatest cross section of the passage 10 inferior to and of the same form as the cross section of the passage through the ingot mold 4. Thus a sudden or abrupt increase of the cross section of the flow passage will occur at the junction or in the plane of contact of adjacent ends of the conduit 3 and the ingot mold 4, and this sudden increase of the cross section is referred to with the reference numeral 11. It is to be understood that this abrupt increase of the flow passage may be different from that shown in the drawing, for instance the end of the tube 3 at the junction may be chamfered or rounded. The portion of the conduit 3 corresponding to the diverging portion of the passage 10 is provided with a device 12 constituting an electromagnetic pump. The device 12 comprises essentially a thin wall of refractory material 13 forming the inner surface of the passage portion through the tube 3 of progressively increasing inner cross section and a linear induction motor 14 is disposed around this thin wall. As can be seen from the drawing, the outer end of the device 12 adjacent to the ingot mold 4 forms the above-mentioned abrupt increase of the flow passage. This end against which the corresponding end of the ingot mold 4 abuts forms at its periphery an annular groove defining with the adjacent end of the ingot mold 4 an annular space 16 communicating with the interior of the ingot mold through a plurality of slots 17 and communicating also through a conduit 18 with a source of fluid under pressure, not shown in the drawing. The linear induction motor 14 constitutes an inductor similar to the known type which is utilized as electromagnetic pump for metals, with the difference that instead the usual cylindrical form of such an induction motor, an induction motor of conical form is used in the present case. The principle of functioning and the construction of such electromagnetic pumps are well known in the art, and it is only mentioned that such pumps comprise a plurality of windings arranged substantially normal to the direction in which the metal is to be pumped, and respectively connected to successive phases of a polyphase source of electric current in such a manner to create a magnetic field which will induce in the liquid metal Foucault currents, which in turn will create a field of electromagnetic forces in the direction of the field lines, and such forces will produce a pumping effect. In the illustrated example, the linear induction motor constituting an electromagnetic pump comprises a plurality of windings 19 of successively increasing diameter arranged in annular slots 20 formed in an armature 21 of generally conical configuration. The windings 19 are connected to successive phases of a three-phase alternating current so as to produce the electromagnetic pumping effect desired. The outer end of the refractory element 12 may be constituted by an element 22 formed from refractory material, for instance silicone nitride. This element 22 constitutes a joint of the type known in the art, and its purpose is essentially limited to the starting and stopping periods of the casting operation, as will be explained later on.

The above-described apparatus will operate as follows: At the start of the casting operation, a rod having substantially the same cross section as the product to be cast is introduced into ingot mold 4. The rod is inserted through the ingot mold 4 so that its inner end provided with anchoring means abuts at 11 against the outer end face of the element 12, whereafter the container 1 is filled with molten metal. The molten metal passing through the passage 10 will engage the anchoring means on the inner end of the rod and solidify thereagainst. The bar is then moved in the direction of retraction, for instance by the rollers 9, and gradually withdrawn from the ingot mold 4. A product solidified at its periphery forms now in the ingot mold and the joint 22 is in contact with the liquid metal during the first instance of movement of the bar. The so far described steps of the operation are conventional steps at the start of an apparatus for continuous casting of metal in horizontal direction.

Simultaneously with the start of movement of the bar, the induction motor 14 is energized to create a pumping effect in the direction of withdrawal of the product which forms in the ingot mold 4. The magnetic field created by the induction motor is substantially diminished by the molten metal in such a manner that the zones of the stream of liquid metal flowing through the passage 10 are the more subjected to the effects of the electromagnetic forces, the closer they are to the internal surface defining the passage 10. Therefore, the induced electromagnetic forces will produce an acceleration essentially in the peripheral portion of the stream of molten metal passing through the passage 10. In other words, the substantially uniform speed profile in any section of the passage 10 is transformed in a nonuniform speed profile in which the speed of the peripheral portion of the stream is much greater than the speed of a central portion thereof. The accelerated metallic masses in the diverging portion of the passage 10 will therefore obtain a substantially kinetic energy when they arrive at 11, i.e., at the plane of the junction of the conduit 3 and the ingot mold in such a manner that the direction of the speed vector will undergo only a small change under the influence of gravity in this region. The stream of metal passes therefor in a progressive manner from the passage 10 into the ingot mold 4. Due to the abrupt increase of the flow passage at 11, there will be formed an annular space 23 free of metal between the inner surface of the ingot mold, the end face of the conduit, respectively the element 22, and the periphery of the stream of molten metal. This space 23 free of metal will assure that the start of the solidification of the metal will take place in the ingot mold. As a consequence thereof, during the casting operation, the element 22 will not function as a joint proper.

Even though the flow conditions of the stream of metal are relatively stable in the zone of the meniscus adjacent to the space 23, it is advantageous to create in the space a pressure at least equal to the conditions prevailing in the interior of the stream of metal. In this case, a neutral gas in injected in the space 23 through a conduit 18 at a pressure at least equal to the maximum ferrostatic pressure in the mentioned zone. The gas fed into the annular space 16 flows therefrom through the slots 17 into the space 23 and established therefore the pressure conditions mentioned above. The injected gas has also the purpose to protect the molten metal against oxidation. Furthermore, it is also possible to inject together with the gas a lubricant material which will lubricate the inner surface of the ingot mold.

At the end of the casting operation, the flow conditions in the zone of the junction of the conduit and the ingot mold will be again the same as in the practice according to the prior art and the element 22 will again have for some moments a function of a joint.

The method according to the present invention may find application in the continuous casting of metal and alloys in horizontal direction, and especially in the casting of alloys having a high melting point, as for instance steel.

The method will assure that during a major part of the casting operation the start of the solidification of the metal will take place in the ingot mold, to assure thereby a perfect surface quality of the cast product and a satisfactory course of the casting operation.

It will be understood that each of the elements described above, or two or more together, may also find a useful application in other types of apparatus for continuous casting of molten metal differing from the types described above.

While the invention has been illustrated and described as embodied in an apparatus for continuously casting molten metal in horizontal direction, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

I claim:

1. A method of continuously casting metal comprising the steps of continuously discharging a stream of molten metal from a container into a cooled substantially horizontally extending ingot mold open at opposite ends through a conduit of refractory material extending axially aligned with the ingot mold between an opening in a side wall of the container and one of the open ends of the ingot mold, and in which the flow passage formed by the inner surface of the conduit and that of the ingot mold abruptly increases at the junction of the conduit and the ingot mold; creating in the stream of metal passing through said conduit of refractory material upstream and adjacent said junction electromagnetic forces for producing in the peripheral zone of the stream of metal an acceleration substantially parallel to the inner surface of said conduit so as to form a liquid meniscus of stable configuration in the region of said junction; and continuously withdrawing the product formed in the ingot mold from the other end of the latter.

2. A method as defined in claim 1, wherein the liquid metal is passed through the conduit of refractory material the cross section of which progressively increases in the direction of the flow of metal therethrough.

3. A method as defined in claim 1, and including the step of injecting a fluid in the region of said meniscus, and maintaining the pressure of said fluid at least equal to the maximum ferrostatic pressure of the liquid metal in said region.

4. A method as defined in claim 2, and including the step of injecting a fluid in the region of said meniscus, and maintaining the pressure of the fluid at least equal to the maximum ferrostatic pressure of the liquid metal in said region.

5. A method as defined in claim 3, wherein said fluid is a neutral gas.

6. A method as defined in claim 1, wherein the meniscus thus formed extends at said junction from the inner surface of said conduit to the inner surface of the ingot mold.

7. Apparatus for continuously casting metal in a horizontal direction comprising a container of refractory material having an opening in a sidewall thereof; means for feeding molten metal into said container; a conduit of refractory material having one end located in said opening; a cooled ingot mold abutting against the other end of said conduit, said conduit and said ingot mold being axially aligned with each other and extending in horizontal direction, the flow passage formed by the inner surface of the conduit and that of the ingot mold increasing abruptly at the junction of the conduit and the ingot mold; electromagnetic means upstream and adjacent said junction for creating in the stream of molten metal passing through said conduit electromagnetic forces for producing in the peripheral zone of the metal an acceleration substantially parallel to the inner surface of said conduit so as to form a liquid meniscus of stable configuration in the region of said junction; and means located downstream of said ingot mold for continuously withdrawing the product formed in the ingot mold from the latter.

8. Apparatus as defined in claim 2, wherein said means for creating said electromagnetic forces comprise an electromagnetic inductor located upstream and closely adjacent to said junction.

9. Apparatus as defined in claim 8, wherein said conduit of refractory material has at least at a portion of its length adjacent said junction an inner cross-section increasing progressively in the direction of flow of liquid metal towards said ingot mold, said means for creating an electromagnetic force surrounding said portion of said conduit.

10. Apparatus as defined in claim 9, wherein said electromagnetic inductor is in the form of a stator of a linear motor arranged about the conduit of refractory material and having a plurality of windings of progressively increasing diameter arranged substantially in planes normal to the axis of said conduit and respectively connected to successive phases of a multi-phase electric current in such a manner to create a moving electromagnetic field shifting parallel to the inner surface of the conduit of refractory material.

11. Apparatus as defined in claim 8, and including means for injecting in the region of said meniscus a neutral gas at a pressure at least equal to the ferrostatic pressure of the liquid metal in said region.

* * * * *